US006026625A

United States Patent [19]

Austin

[11] Patent Number: 6,026,625

[45] Date of Patent: Feb. 22, 2000

[54] ANGULAR INTERLOCKING FLOOR TILE

[76] Inventor: John Austin, 88 Grace Ter., Pasadena, Calif. 91105

[21] Appl. No.: 08/935,357

[22] Filed: Sep. 22, 1997

[51] Int. Cl.[7] ..... E04B 2/08

[52] U.S. Cl. ..... 52/591.5; 52/592.2; 52/590.2; 52/387; 52/311.2; 404/36; 404/41; 404/42

[58] Field of Search ..... 52/590.2, 591.4, 52/591.2, 591.3, 592.1, 592.2, 589.1, 387, 591.5, 311.2; 404/35, 36, 34, 41, 42

[56] References Cited

U.S. PATENT DOCUMENTS 4,497,858 2/1985 Dupont .
4,550,543 11/1985 Valenzano .
5,137,392 8/1992 McCoy .
5,173,003 12/1992 Hair .
5,186,574 2/1993 Tavares .
5,230,584 7/1993 Grossman .
5,466,089 11/1995 Jurik .
5,630,304 5/1997 Austin .

*Primary Examiner*—Christopher T. Kent
*Assistant Examiner*—Yvonne Horton-Richardson
*Attorney, Agent, or Firm*—John F. Sicotte

[57] ABSTRACT

A angular interlocking floor tile is provided with a generally flat top surface, a parallel bottom surface, wherein the tile includes two elongated sides which converge to a point or short inner side at one end and which sides diverge at an internal angle of less than 90° to be joined at their other ends by a beveled outer edge surface. The elongated sides are formed with a plurality of female cavities located adjacent to each of the sides. Each of the female cavities is positioned to mate with a corresponding male connecting member of a neighboring tile of a runner mat whereby the runner mat is able to make variety of turns. Alternatively, each of the elongated sides may be formed with an additional integral interlocking strip having male connecting members which may be used to mate with a corresponding female cavities of a neighboring tile. When the interlocking strip is not needed it may be removed.

6 Claims, 4 Drawing Sheets

ANGULAR INTERLOCKING FLOOR TILE

DESCRIPTION OF THE RELATED ART

In factories or businesses runner mats are commonly used in many areas such as manufacturing and assembly areas. Generally, runner mats are several feet wide and are constructed of rubber or vinyl materials. Such mats may be formed as a continuous long integral piece, which may extend seventy-five feet or more. Runner mats may also be constructed from mat individual tiles which are interlocked together to form a continuous mat of any length. For example, one type of interlocking tile is described in my U.S. Pat. No. 5,630,304, issued May 20, 1997, wherein rectangular tiles with beveled edges formed with interlocking strips are attached together to form a rectilinear runner mat. In general, unitary runner mats or runner mats formed from mat tiles are linear devices by nature. They are formed into long continuous straight walk-ways and are only able to make turns at right angles. Such turns may accomplished by forming "L-shaped" turns or "T-shaped" intersections. When a turn is required a runner mat is typically modified by being cut with a utility knife and the remnant moved into position to cause the runner to travel a in the new direction. Oftentimes the remnant does not have any interlock means and it is simply placed perpendicular to the original mat to form a L-shaped turn or a T-shaped intersection. If individual interlocking tiles are being used, the installer would simply attach the new tile perpendicular to the direction of the last runner mat that had been installed. As can be readily seen, both of these methods contain severe inherent limitations which preclude the selection of turns other than a full right turn. Nevertheless-less, in many settings it would be highly desirable to have a runner mat to smoothly veer back and forth around equipment, posts and other obstructions. When an installer is restricted to the right angle turns of the prior art, he must often settle for misalignment of the runner mat with doorways and hallways or a finished product which is awkward in appearance.

Another problem when using rectangular tiles to form a runner mat occurs at the point when the direction of the mat must be changed to avoid an obstacle. At times an installer will simply terminate the runner mat and then place loose tiles to form a crude curving runner mat. The installer would then begin a new runner mat once the curve had been completed. This approach to forming a curving runner mat has proven to unacceptable in use because the tiles are not mechanically attached to one another. A person who walks or pushes a cart through the curved section will naturally impart lateral forces toward the outside of the curved section, thereby causing the tiles to travel over the flooring surface. Such tiles will need constant attention and will need to be placed back into position. Without such attention the slightest gap between the mat tiles will make them vulnerable to increased wear and tear and raising up their edges to produce a safety hazard.

It is therefore desirable to provide for a new and unique interlocking floor tile, for use in the construction of an integrally formed runner mat which is mechanically sound for forming walk-ways through manufacturing and assembly plants and the like. The invention herein permits the construction of a curving runner mat which is able to accomplish a wide variety of changes of direction with all of the safety features of a straight runner mat.

Runner mats are typically assembled by interlocking together rectangular floor tiles, constructed of natural or synthetic rubber. Interlocking runner tiles are generally three feet in width with a row of female cavities along one edge and a male interlocking strip along the opposite edge. Such floor tiles all contain the same inherent limitation of being restricted to form linear patters. The tiles must follow a direction of travel which is either straight ahead or perpendicular to the direction of travel. The angular floor tile, which is the subject of this invention, is particularly adapted to be attached by an interlocking strip to the edge of a typical rectangular floor tile and then to cause the direction of the walk-way to swerve at a variety of angles less than ninety degrees. It needs to be understood that the interlocking strip may be formed as an integral part of either the rectangular floor tile or the angular floor tile. Further, the angular floor tile may have both of its interlocking edges formed with male interlocking strips and adjacent female interlocking cavities. With a tile having this type of construction the installer would have the option to make any change of direction he desires and he could simply remove the male interlocking strips as needed.

SUMMARY OF THE PRESENT INVENTION

The problems noted above are overcome by the use of wedge-shaped tiles of the instant invention which can be interlocked with an in-line series of rectangular floor tiles forming a runner mat to allow the mat to veer around obstacles. This desired result is achieved by providing a wedged-shaped tile having a body portion having a first and second opposed sides of equal length which meet at one end and which diverge outward at an acute angle to be joined at their opposite ends by a third side. Both the first and second sides include a plurality of female interlock cavities integrally formed in the underside of the body portion and which extend the entire length of each side.

According to another feature of the invention, some or all of the edges of the wedge-shaped tile may be rounded or beveled to provide a finished safety edge Along with the rounding of the edge, the first and second opposing edges may also include an integrally formed interlocking strip which extends outward from the tile. Such strips when not used for interlocking purposes can be cut off to provide for a finished safety edge.

According to a further feature of the invention, the third or outer edge may be constructed in a variety of shapes, such as straight or angled. The third edge may also be formed as a arcuate edge with a radius of curvature equal to the length of the first and second edges, thereby allowing the line of the third edge to smoothly follow the direction of travel of the runner mat.

According to a further feature of the invention, a single wedge-shaped tile may be used to change the direction of travel of a runner mat in either direction without any modification to the edges, to the interlocking means or to the outside edge. The tile may also be combined with other tiles made according to the invention with different acute angles to achieve an infinite variety of changes of direction.

It is the object of this invention to provide an angular interlocking floor tile which can be employed to allow a runner mat to change directions at less than right angles.

It is a further object of this invention to provide an wedge-shaped tile which is adaptable to be used with rectangular floor tiles having beveled edges and interlocking strips.

It is a still further object of this invention to provide a single wedge-shaped floor tile which can be added to a runner mat to make either right hand turns or left hand turns without any modifications.

Other objects and features of this invention will be pointed out in the following description and claims and illustrated in the accompanying drawings, which disclose by way of example, the principles of the invention, and the best mode which has been contemplated for carrying them out.

BRIEF DESCRIPTION OF THE DRAWINGS

In the drawings similar elements are given similar reference characters.

DETAILED DESCRIPTION OF THE INVENTION

Figure 1:
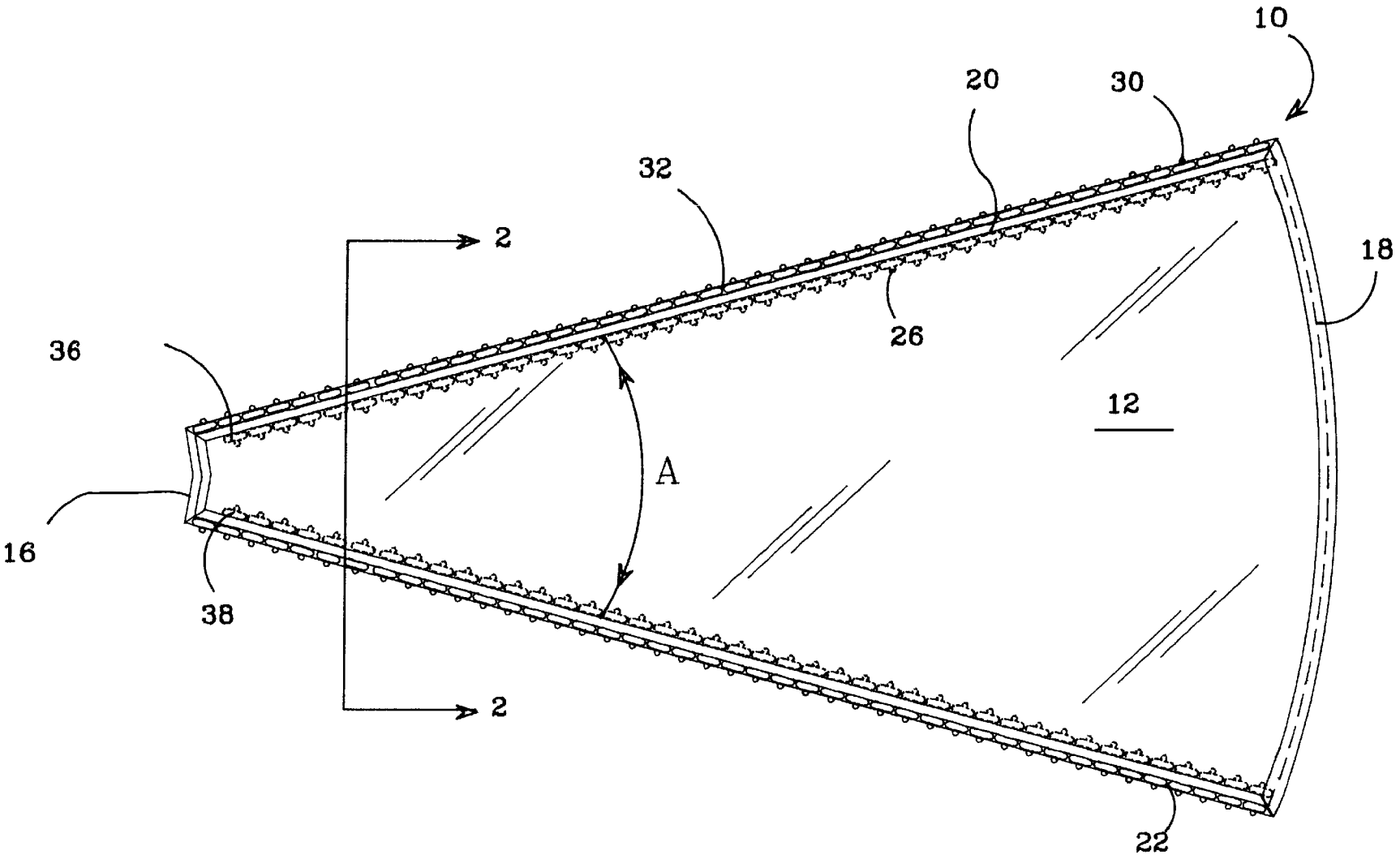
FIG. 1 is a top plan view of a angular floor tile constructed in accordance with the concepts of the invention.
Figure 2:
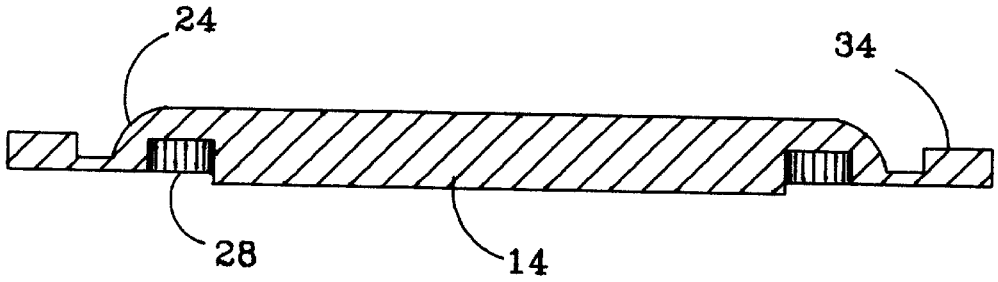
FIG. 2 is a side elevational view of the angular floor tile, in cross-section, taken along the line 2—2 in FIG. 1.

Referring now to FIGS. 1 and 2 of the drawings the angular or wedge-shaped floor tile 10 constructed in accordance with the concepts of the invention. Tile 10 is shown having a top surface 12 and a bottom surface 14 and a general wedge shape defined by an inner edge 16, an outer edge 18 and two long edges of equal length, 20 and 22, respectively. Edges 20 and 22 diverge at an internal angle A, which is an angle of 30° in the preferred embodiment. Each of the edges 16, 18, 20 and 22 have been formed with a rounded or beveled surface. This is clearly illustrated at reference numeral 24 in FIG. 2. It should also be noted that in this preferred embodiment of the invention that both edges 20 and 22 have been formed with two sets of interlocks along each edge. In FIG. 1 it can be seen that edge 20 has a plurality of female cavities 26 (shown in phantom) have integrally formed within bottom surface 14 for nearly the entire length of edge 20. A cross section of a single female cavity may be seen in FIG. 2 at reference numeral 28. In addition to female cavities 28 edge 20 also has an equal number of male interlocks 30 supported by an interlock strip 32 which has been integrally formed with edge 24. A male interlock and the supporting interlock strip is illustrated in cross section in FIG. 2 at reference numeral 34. On the opposite side of top surface 12 is edge 22 which is a mirror image of edge 20. It contains the same beveled edge with an integrally formed interlock strip with the same number of male and female interlock elements, located in the same positions along edge 22.

At the narrow end of tile 10 is inner edge 16 which joins edge 20 and 22. The length of inner edge 16 is determined by the size and location of female interlock cavities which are immediately adjacent. As can be seen in FIG. 1 an interlock cavity 36 is located at an extreme end of edge 20 and directly opposite interlock cavity 38. In order to accommodate both interlock cavity 36 and interlock 38, inner edge must be made with sufficient length. In general the length must be twice the width of a female cavity plus an additional length to allow for sufficient supporting material around the cavities.

At the opposite end of tile 10 is outer edge 18 which is shown in FIG. 1 as having a beveled surface and curved in an arcuate shape. In the preferred embodiment the shape of outer edge 18 was determined by finding a radius of curvature which was equal to the length of edge 20. In use the arcuate edge of tile 10 serves to establish a curved line that closely follows the changes of direction of a runner mat. In this way someone walking down a meandering runner mat may easily anticipate and follow changes of direction. This is especially important in crowded factory settings where the view may be obstructed or the lighting is poor. Of course, outer edge 18 may be formed with a variety of differ shapes, such as a straight line between the ends of edges 20 and 22 or it may have an angular or dogleg appearance with two straight segments. An example of this type may be seen in FIG. 5.

Figure 4:
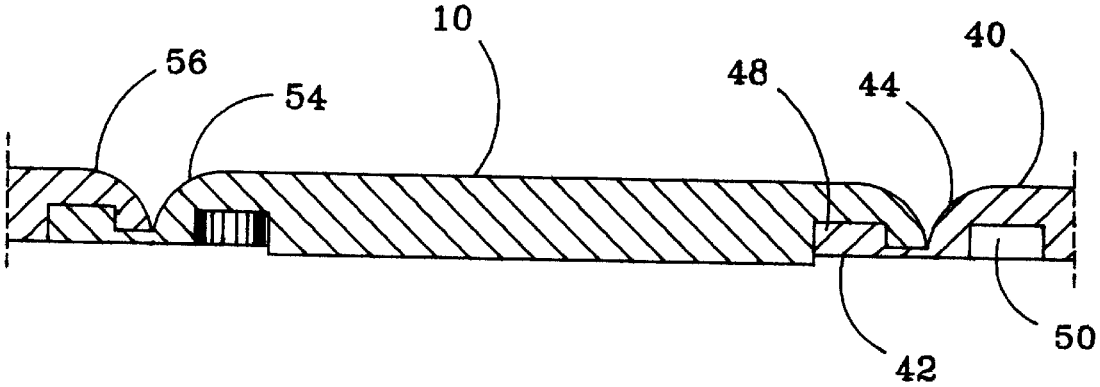
FIG. 4 is a side elevational view of the angular floor tile, in cross-section, taken along the line 4—4 in FIG. 3.
Figure 3:
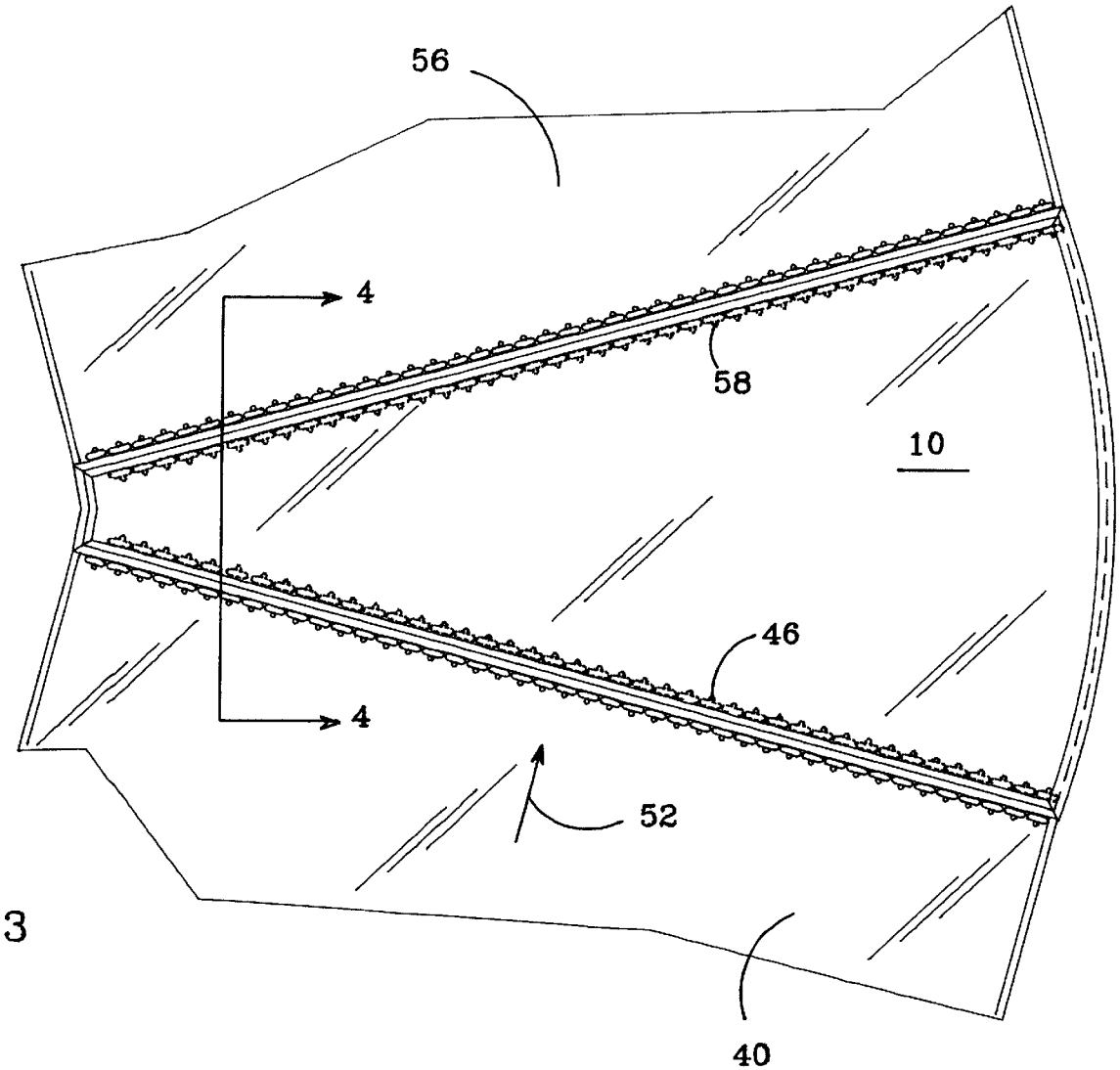
FIG. 3 is a top plan view of a runner mat which contains partial views of two rectangular floor tiles attached to the edges of the invention.

Typically, the preferred embodiment of the present invention will be used to cause a runner mat to change direction at a angle less than 90°. An example of such use is illustrated in FIGS. 3 and 4. Partially shown is runner mat 40 which is rectangular in shape with an integral male interlock strip 42 extending from edge 44. It may be seen in FIG. 3 that the female interlock cavities 46 are now filled by the male interlocks supplied by mat 40. A single such interlocking relationship is illustrated in FIG. 4 wherein male interlock 42 has been inserted into a female cavity 48 of tile 10. At this point it should be noted that tile 10 is shown in FIG. 1 as having two male interlocking strips with one extending outward from each of edge 20 and 22. In FIG. 3, however, the interlock strip (now shown as a phantom void 50) which would have been adjacent to mat 40 has been removed from tile 10 and discarded. The reason for this is that sometimes a runner mat is being installed with the male interlocking strip on the leading edge, traveling in the direction of arrow 52 in FIG. 3. This condition usually will occur when the installer begins with the first runner tiles having its finished or safety edge at the beginning of a run. The result is that the interlocking strip must always be at the leading edge of the run. With the present invention the installer has the choice of cutting off the interlocking strip from the runner mat or from the invention. The preferred embodiment can accommodate either condition. This is illustrated in FIG. 4 at reference numeral 54 where tile 10 is shown as being interlocked with next runner tile 56. In this situation the female interlocks of tile 10 are not used and are shown as being unfilled.

Figure 6:
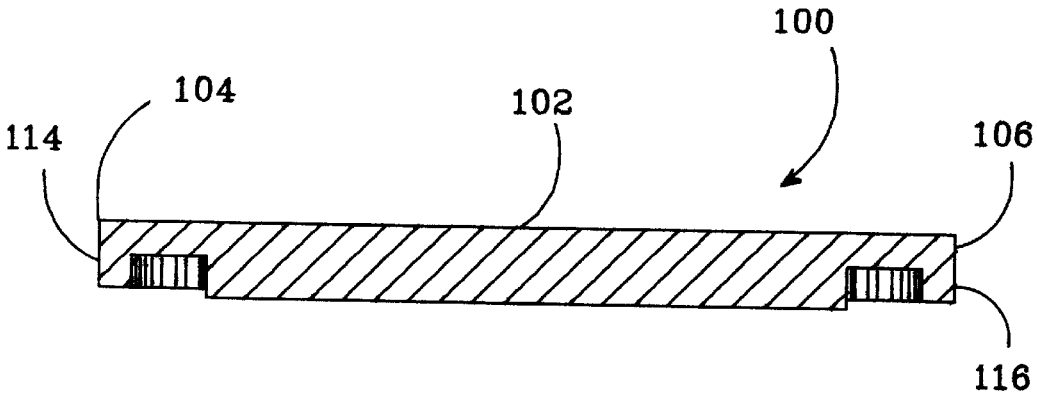
FIG. 6 is a side elevational view of the angular floor tile, in cross-section, taken along the line 6—6 in FIG. 5.
Figure 5:
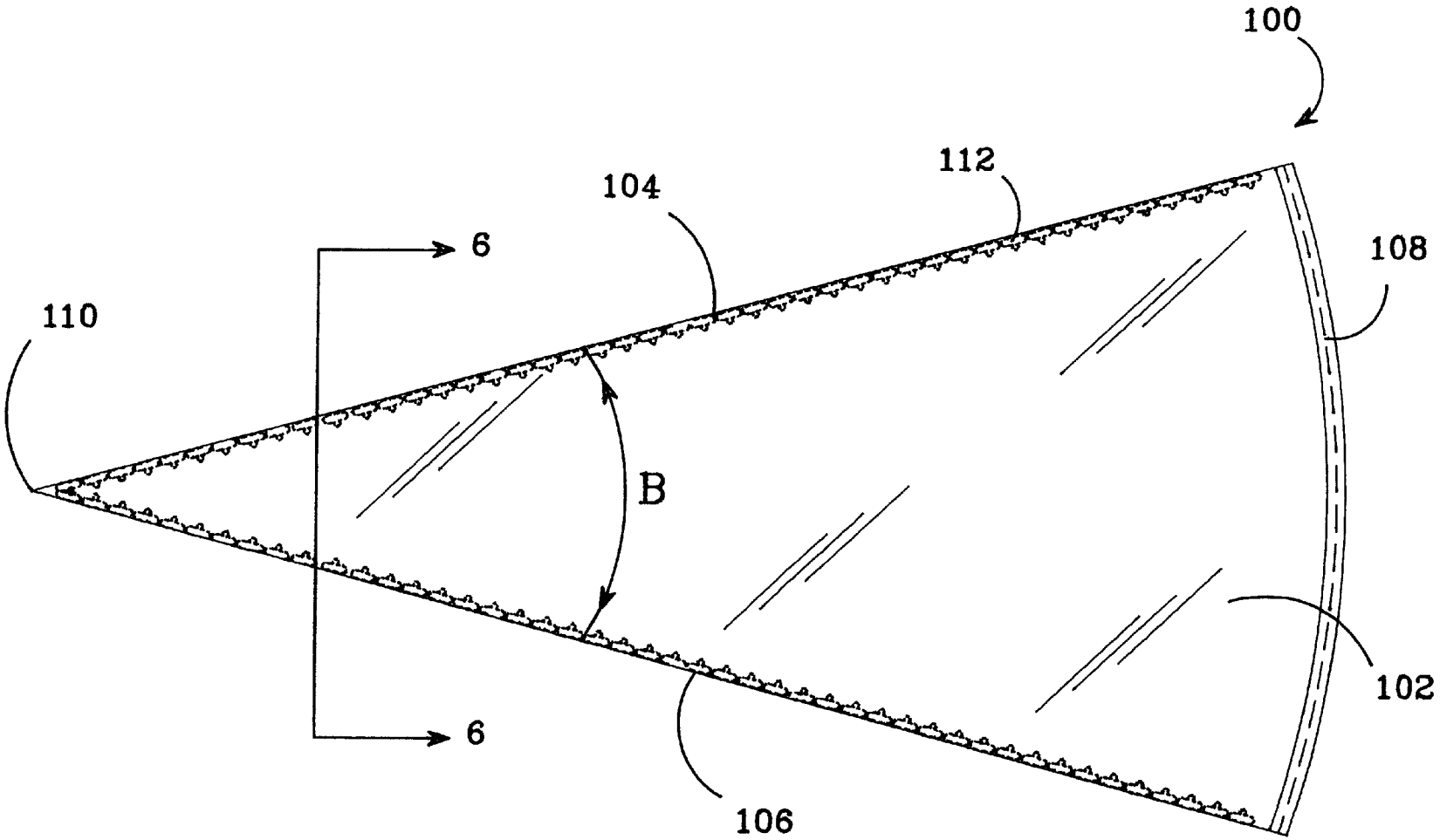
FIG. 5 is a top plan view of an alternative embodiment of the angular floor tile in FIG. 1 constructed in accordance with the concepts of the invention.

Turning now to FIGS. 5 and 6 there is shown an alternative embodiment of the invention in the form of a angular floor tile 100 having three sides. Tile 100 has a wedge-shaped top surface 102 which is defined by a first edge 104, a second edge 106 and a outer edge 108 extending between first edge 104 and second edge 106. Edges 104 and 106 are of equal length and are joined at one end at a internal angle of 30° which is designated as angle B in FIG. 5. In needs to understood that angle B can be any angle less than 90° depending upon the practical limitations of constructing runner mats most efficiently. For most purposes an angular mats with internal angles of 30° and 45° will meet most of requirements of any installation. Mats of the same or different internal angles may also be combined to create a variety of turns with different radii to circumvent a series of non-aligned obstacles. Nevertheless, there is no limitation on producing a angular floor tile according to this invention with any internal angle less than 90° if it so desired.

The alternative embodiment of the invention shown in FIGS. 5 and 6 differs in several respects from the preferred embodiment discussed earlier. Most notable is that the alternative embodiment is essentially a three sided tile. Edges 104 and 106 converge to form a point 110, there by eliminating the inner edge. As a result edge 104 has a line of female cavities 112 which terminate prior to reaching point 110 due to the lack of space. Likewise, edge 106 has line of female cavities which must stop short of reaching point 110. Upon installation of the adjacent floor tile the corresponding male interlocks must be removed. This results in an interlock connection being slightly is strong than in the preferred embodiment. On the other hand the alternative embodiment does allow for a differently appearing runner mat and a somewhat tighter turning radius.

Alternative embodiment 100 also demonstrates some other features which can also be applied to the preferred embodiment. Outer edge 108 has the same beveled edge but is shown as having a dogleg or angular appearance. As discussed earlier outer edge 108 may also be formed as a straight line between the ends of edge 104 and 106. Another difference in the alternative embodiment is that it lacks any male interlocking strips extending from edges 104 and 106. This somewhat limiting in that the floor tile must rely on the rectangular floor tiles to supply the male interlock. However, this type of mat has the advantage of being easier and less expensive to manufacture. This floor tile may also be supplemented with a narrow accessory strip with back to back male interlocks should the need arise.

Finally, it should be noted that alternative embodiment 100 is shown without a beveled edge along either edge 104 or edge 106. In FIG. 6 edge 104 is shown in cross section as having a vertical edge 114. Likewise, edge 106 is shown as having a vertical edge 116. Angular floor tiles with this type of edge are matched with rectangular tiles with similar edges to yield a runner mat having seams which are virtually flat. Of course, it should be understood that either edge 104 or edge 106 may be manufactured to include a male interlocking strip if it is so desired.

The angular floor tile of either the preferred embodiment or the alternative embodiment may be constructed of natural rubber, synthetic rubber, plastic or any other like suitable material.

WHEREAS, a preferred embodiment and an alternative embodiment of the invention has been illustrated and described in detail, it will be apparent that various changes may be made in the disclosed embodiments without departing from the spirit of the invention.

What is claimed is:

1. An angular floor tile for altering the direction of a walking surface, comprising:

a. a top surface, a parallel bottom surface, and four edge surfaces extending between said top surface and said bottom surface;

b. said four edge surfaces being composed of a first edge surface and a second edge surface, an inner edge surface, which has a first end joined to one end of said first edge surface and a second end joined to said second edge surface, and a smooth arcuate outer edge surface;

c. said first edge surface and said second edge surface being disposed as two opposing sides of said angular floor tile which diverge at an internal angle of less than 90° and terminate at their opposite ends by said outer edge surface; and, d. said first edge surface and second edge surface having an interconnecting means located within said first edge surface and within said second edge surface, each of said interconnecting means being positioned to mate with a connecting means of a like tile.

2. The angular floor tile in claim 1, wherein said internal angle is 45° or less.

3. The angular floor tile in claim 1, wherein at least one of said edge surfaces further comprises an integrally formed interlock strip which extends outwardly from said edge and supports a plurality of male interconnecting members, each of said members being positioned to mate with a female cavity of another like tile.

4. The angular floor tile in claim 1, wherein said first edge surface and said second edge surface further comprise a downwardly sloping edge, inclining outwardly from said top surface to said bottom surface.

5. The angular floor tile in claim 3, wherein said first edge surface and said second edge surface further comprise a downwardly sloping edge, inclining outwardly from said top surface to said bottom surface.

6. The angular floor tile in claim 5, wherein said outside edge surface further comprises a downwardly sloping edge, inclining outwardly from said top surface to said bottom surface.

* * * * *